US006996872B2

(12) United States Patent
Tennant

(10) Patent No.: US 6,996,872 B2
(45) Date of Patent: Feb. 14, 2006

(54) MOLDED PLASTIC PAINT ROLLER TRAY

(75) Inventor: Steven C. Tennant, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 473 days.

(21) Appl. No.: 09/969,088

(22) Filed: Oct. 2, 2001

(65) Prior Publication Data

US 2003/0061678 A1 Apr. 3, 2003

(51) Int. Cl.
*B05C 1/02* (2006.01)
*B05C 21/00* (2006.01)
*B65D 1/00* (2006.01)

(52) U.S. Cl. ..... 15/257.05; 15/257.06; 220/570

(58) Field of Classification Search ..... 15/257.06, 15/257.05; 220/501, 570, 735, 736; 206/577, 206/519, 506
See application file for complete search history.

(56) References Cited

U.S. PATENT DOCUMENTS 3,139,188 A * 6/1964 Goertz et al. ..... 211/133.6
3,380,100 A * 4/1968 Pharris et al. ..... 15/257.06
4,010,866 A * 3/1977 McClane ..... 220/570
4,164,803 A * 8/1979 Zurawin et al. ..... 15/257.05
4,297,762 A 11/1981 Crysdale
D273,725 S * 5/1984 Goetz ..... D32/53.1
4,509,226 A * 4/1985 Allison et al. ..... 15/257.06
4,815,604 A * 3/1989 O'Neil et al. ..... 206/518
5,038,955 A * 8/1991 Studer et al. ..... 220/736
5,071,008 A * 12/1991 Hradisky ..... 206/507
5,533,228 A 7/1996 Jarecki et al.
5,645,164 A 7/1997 Hocking
D383,579 S 9/1997 Samson
5,735,399 A 4/1998 Ste. Marie
5,746,345 A 5/1998 Zurawin
6,022,588 A * 2/2000 Wakat ..... 427/262
6,471,086 B1 * 10/2002 Fleckenstein ..... 220/570
2003/0042262 A1 * 3/2003 Young ..... 220/570

* cited by examiner

*Primary Examiner*—John Kim
*Assistant Examiner*—Shay L. Balsis
(74) *Attorney, Agent, or Firm*—Renner, Otto, Boisselle & Sklar, LLP

(57) ABSTRACT

A paint roller tray includes a paint roller reservoir adjacent one end and a roll off area sloping upwardly away from the paint roller reservoir. The slope of the roll off area is maintained by a support member longitudinally spaced from the paint roller reservoir. The support member is comprised of one or more compartments each having a closed bottom and open top, and an inner wall extending above the upper end of the roll off area to separate each compartment from the roll off area.

11 Claims, 7 Drawing Sheets

MOLDED PLASTIC PAINT ROLLER TRAY

FIELD OF THE INVENTION

This invention relates to a molded plastic paint roller tray particularly for use with larger size paint rollers.

BACKGROUND OF THE INVENTION

Paint roller trays are typically not more than 12 inches wide and 16 inches long. Trays within this size range will accommodate most paint rollers. However, there is also a need for larger size paint roller trays having a width, for example, of 20 or more inches and a length for example of 15 or more inches for accommodating larger size paint rollers having roller covers, for example, 18 inches long or longer.

The smaller size plastic paint roller trays are relatively easy to injection mold. However, it is much more difficult to economically injection mold larger size plastic paint roller trays that have the requisite strength for supporting an adequate supply of paint for the larger size paint roller covers and that are sufficiently rigid to permit even rolling of paint out of the larger size paint roller covers while allowing excess paint to return to the paint roller reservoir. Also, there is a need to provide such paint roller trays with a plurality of compartments that are separated from the roll off area for holding paint applicators such as paint brushes and the like.

As used herein, the term "paint" is intended to encompass other liquid coating materials besides paint including stain, polyurethane and the like.

SUMMARY OF THE INVENTION

In accordance with one aspect of the invention, a molded plastic paint roller tray is provided with stiffening ribs extending along upper edges of the side and end walls of the tray and along an under side of the tray roll off area.

In accordance with another aspect of the invention, at least some of the stiffening ribs are hollow.

In accordance with another aspect of the invention, the paint roller tray includes an upwardly sloping roll off area having a plurality of longitudinally spaced rows of raised V-shape ribs extending across the width of the roll off area. The ribs in each row are spaced apart from each other and face away from a paint roller reservoir adjacent the lowermost end of the roll off area. Also, the ribs in each row overlap the ribs in each adjacent row to aid in evenly rolling paint out of a paint roller cover while allowing any excess paint to flow around the ribs and return to the paint roller reservoir.

In accordance with another aspect of the invention, the paint roller tray has a support member longitudinally spaced from the paint roller reservoir for maintaining the slope of the roll off area when the tray is placed on a flat surface that is comprised of a plurality of compartments that are open at the top and closed at the bottom for holding one or more paint applicators such as paint brushes and the like.

In accordance with another aspect of the invention, the support member has an inner wall that extends upwardly above the uppermost end of the roll off area to separate the compartments from the roll off area.

In accordance with another aspect of the invention, one or more of the compartments has an upwardly and outwardly sloping side wall for supporting a brush on its side within the compartment(s).

In accordance with another aspect of the invention, the paint roller tray includes two side compartments and a middle compartment between the two side compartments for holding paint applicators.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
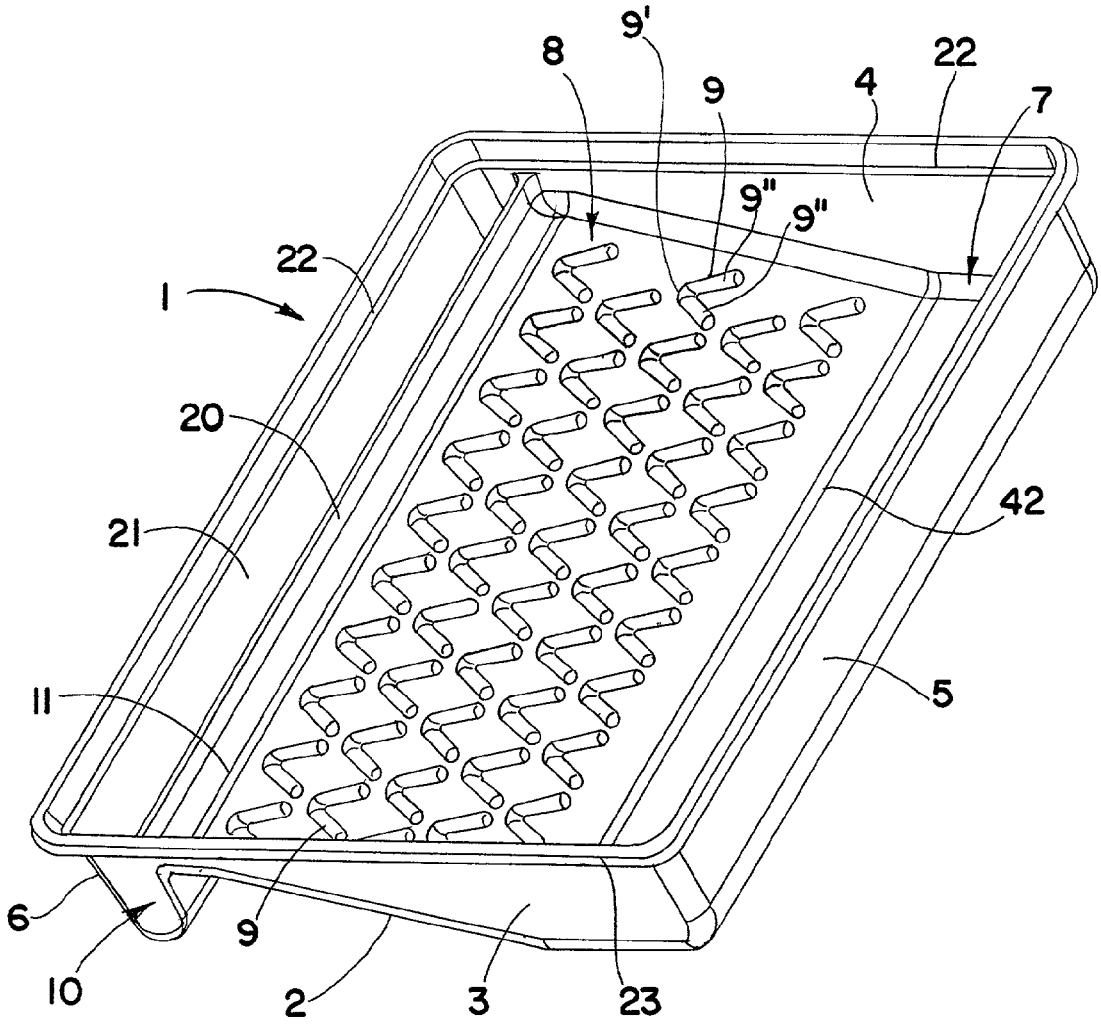
FIG. 1 is a perspective view of one form of paint roller tray in accordance with the present invention.

Referring now in detail to the drawings, there is shown one form of injection molded plastic paint roller tray 1 in accordance with this invention of a size for accommodating larger size paint rollers having for example roller covers that are 18 inches long. The tray includes a bottom wall 2 and side and end walls 3–6. Adjacent the front end wall 5 is a paint roller reservoir 7 which may be sized to hold a relatively large quantity of paint, for example, a gallon or more. As previously noted, the term "paint" as used herein encompasses other liquid coating materials besides paint including stain, polyurethane and the like.

Figure 2:
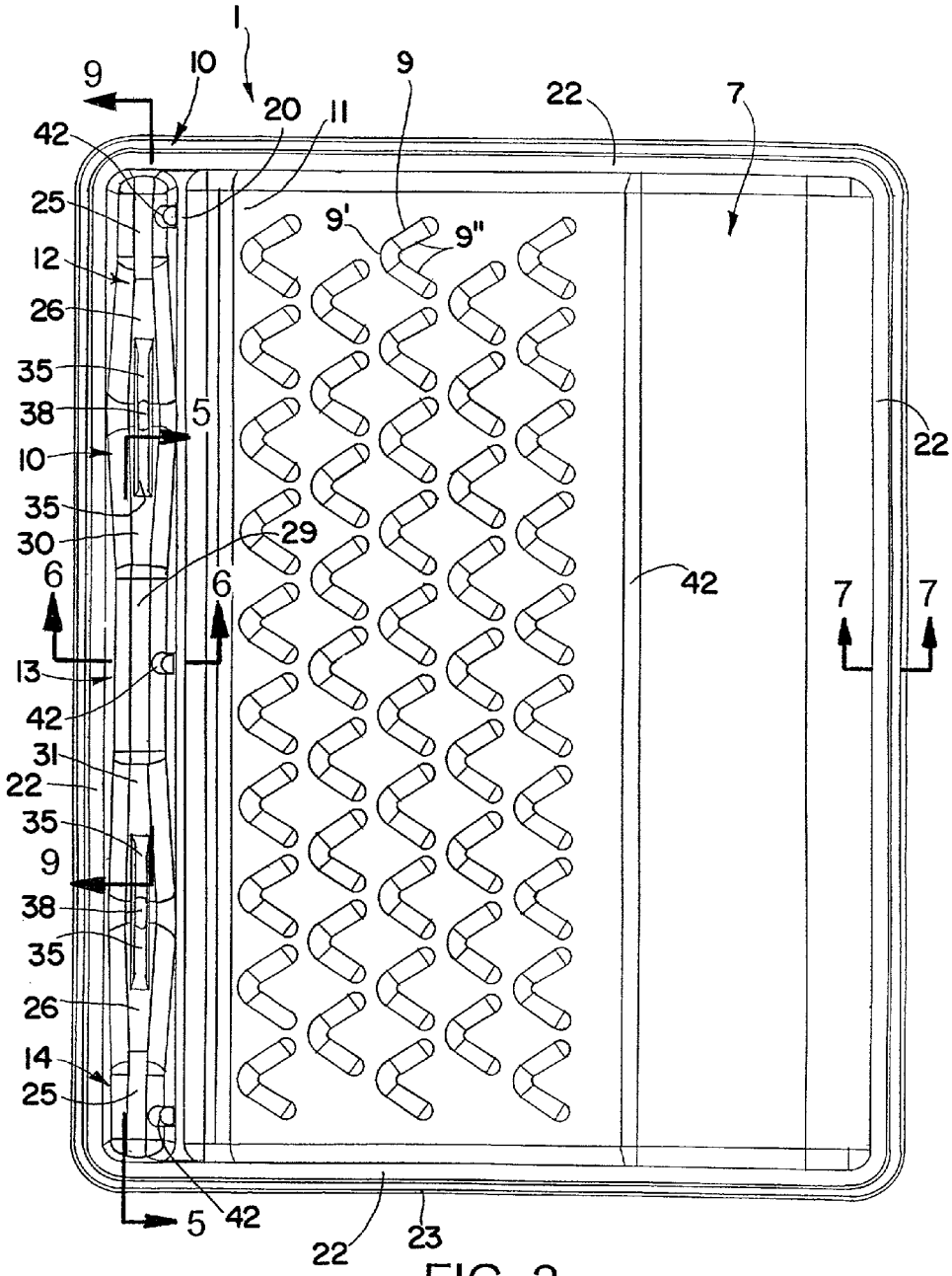
FIG. 2 is an enlarged top plan view of the paint roller tray of FIG. 1.
Figure 8:
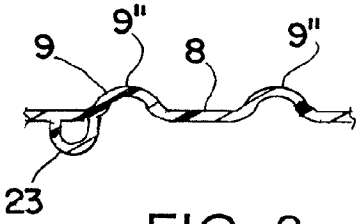
FIG. 8 is an enlarged fragmentary transverse section through the roll off area of the paint roller tray as seen in FIG. 3, taken along the plane of the line 8—8.
Figure 7:
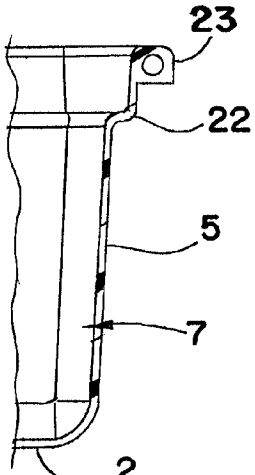
FIG. 7 is an enlarged fragmentary longitudinal section through the end wall at the right hand end of the paint roller tray as seen in FIG. 2, taken along the plane of the line 7—7.

Sloping upwardly and rearwardly away from the paint roller reservoir 7 is a roll off area 8 that includes a plurality of longitudinally spaced rows of raised V-shape ribs 9 extending across the width of the roll off area. Each rib 9 has a V portion 9' formed by a pair of intersecting straight sides 9". Ribs 9 are integrally molded into the roll off area 8 and have substantially the same wall thickness as the planar surface of the roll off area 8 as shown in FIG. 8. Also all of the ribs 9 in each row are laterally spaced apart from each other to provide a space between each of the ribs in each row with the V portions 9' of the ribs facing away from the paint roller reservoir 7 as shown in FIGS. 1 and 2 to permit paint to flow between the ribs in each row. Further, the straight sides 9" of the ribs 9 in each row overlap the space between the ribs 9 in each adjacent row to aid in evenly rolling paint out of a paint roller cover while allowing any excess paint to flow between the ribs in each row and back to the paint roller reservoir 7.

Figure 5:
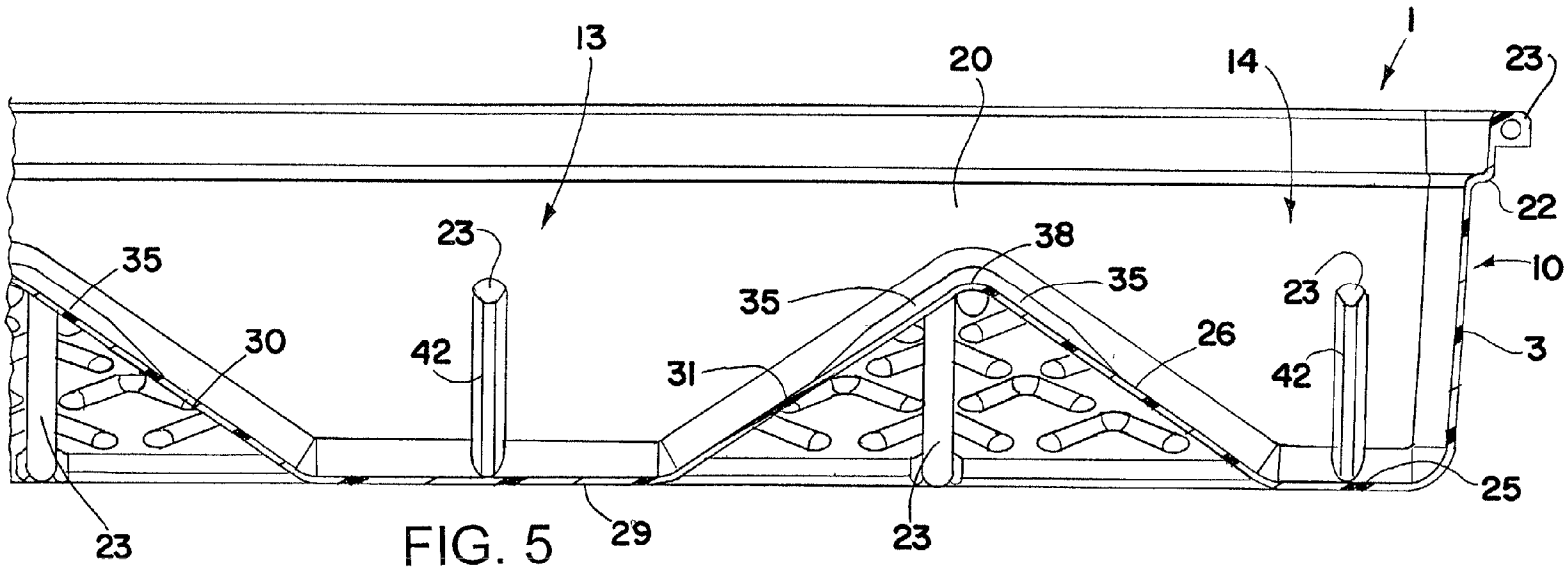
FIG. 5 is a further enlarged fragmentary transverse section through two compartments within a support member adjacent the left hand end of the paint roller of FIG. 2, as seen from the plane of the line 5—5.
Figure 6:
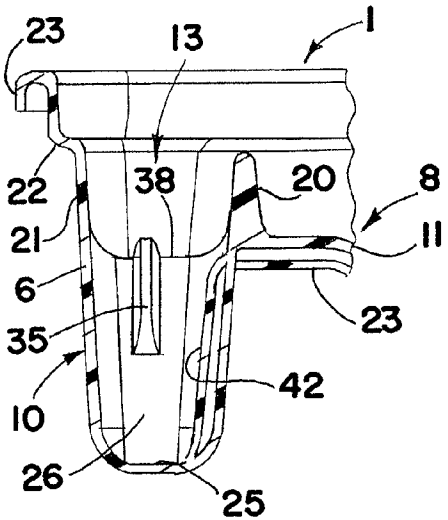
FIG. 6 is an enlarged fragmentary longitudinal section through the middle compartment of the support member as seen in FIG. 2, taken along the plane of the line 6—6.

Rearwardly spaced from the paint roller reservoir 7 is a support member 10 that extends downwardly below the uppermost end 11 of the roll off area 8 for maintaining the slope of the roll off area when the tray 1 is placed on a flat surface. Support member 10 is comprised of a plurality of compartments 12–14 each open at the top and closed at the bottom as shown in FIGS. 2, 5, 6 and 9 for holding one or more paint applicators such as paint brushes and the like. Support member 10 has an inner wall 20 that is integral with the uppermost end 11 of roll off area 8 and an outer wall 21 outwardly spaced from the inner wall that form the inner and outer walls of the compartments. Also, inner wall 20 extends upwardly above the uppermost end 11 of roll off area 8 across the entire width of the tray to separate the compartments 12–14 from roll off area 8 as shown in FIGS. 1, 2 and 6 and make the compartments deeper. Similarly, outer wall 21 extends upwardly above the uppermost end of the roll off area across the entire width of the tray to make the compartments deeper.

Figure 3:
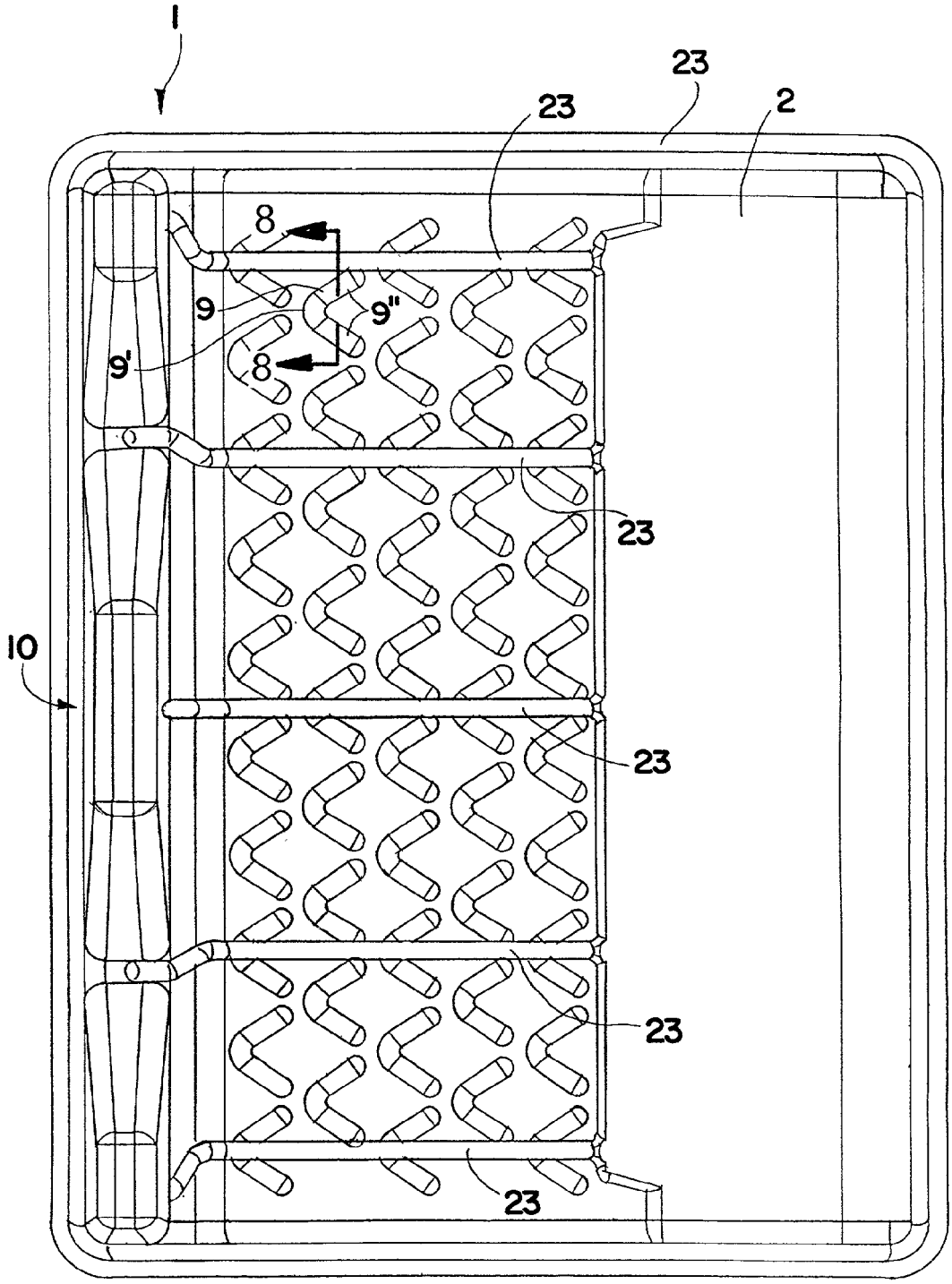
FIG. 3 is an enlarged bottom plan view of the paint roller tray of FIG. 1.
Figure 4:
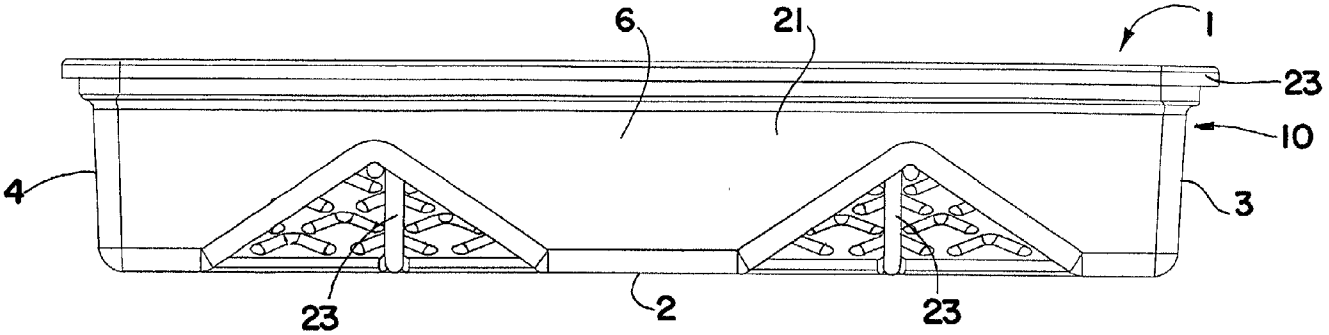
FIG. 4 is an enlarged end elevation view of the paint roller tray of FIG. 1 as seen from the left hand end thereof.

Adjacent the upper ends of the inner and outer walls 20–21 of support member 10 is a radially outwardly and upwardly stepped shoulder 22 that extends around the entire periphery of the tray to give the tray added rigidity. Also, stiffening ribs 23 extend along the uppermost edges of the side walls 3, 4 and end walls 5 and 6 of the tray and along the under side of the roll off area 8 (see FIG. 3) to give the tray the requisite strength to be able to support the weight of the paint in the paint roller reservoir 7 and to permit even rolling of paint out of a paint roller cover on the roll off area 8. In the embodiment disclosed herein, five laterally spaced longitudinally extending ribs 23 are provided on the under side of the roll off area 8 as schematically shown in FIG. 3.

Figure 9A:
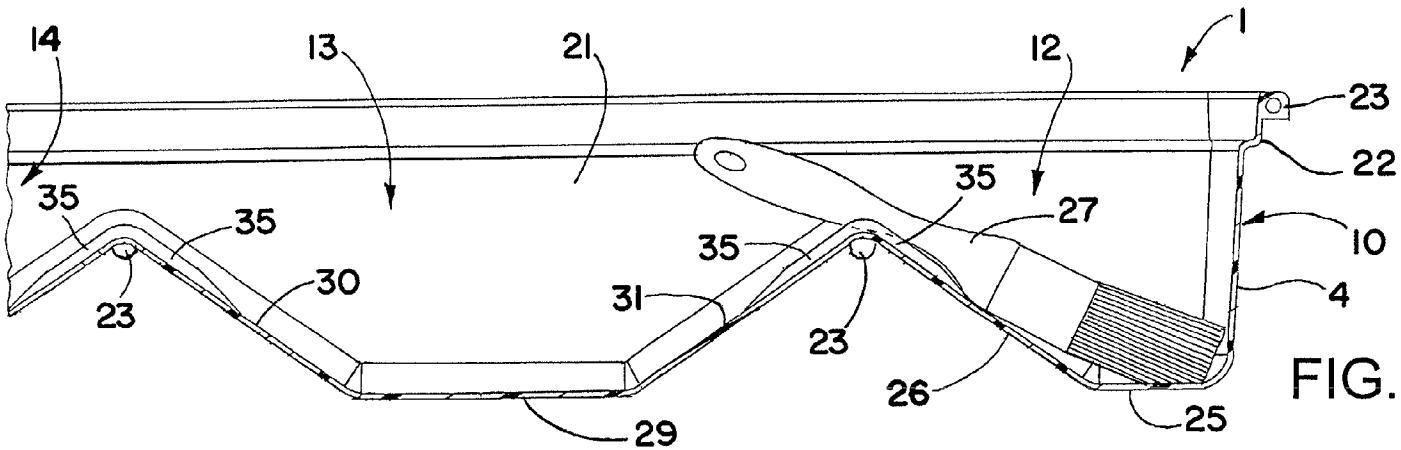
FIGS. 9A–9E are enlarged fragmentary transverse sections through two of the compartments of the support member as seen from the plane of the line 9—9 of FIG. 2, but showing different ways in which paint brushes (and in the case of FIG. 9E, a paint stick) may be supported within the different compartments.
Figure 9B:
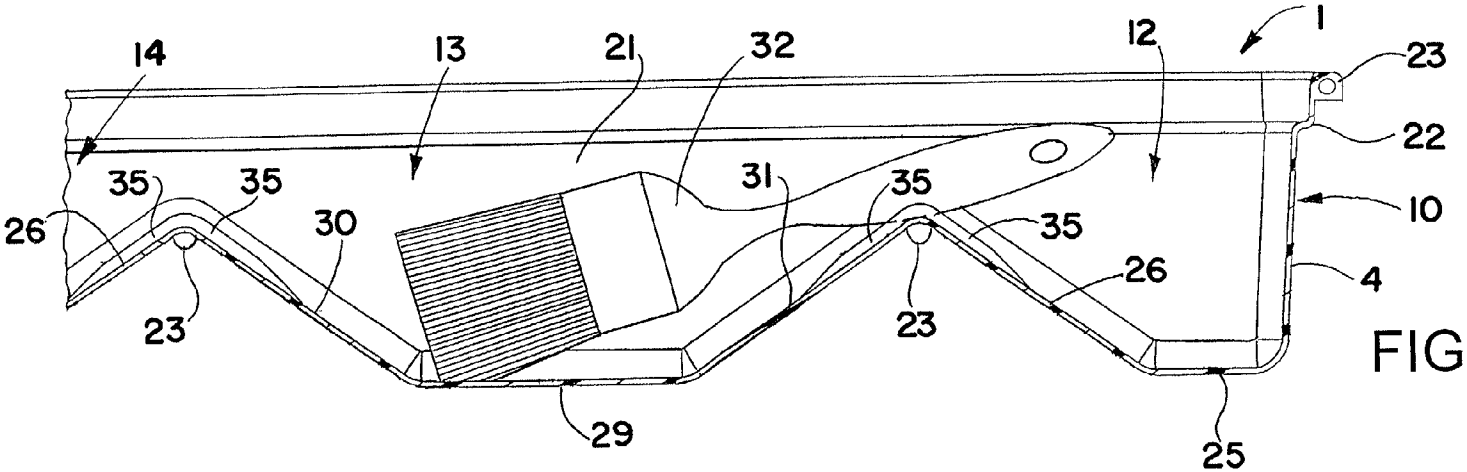
Figure 9C:
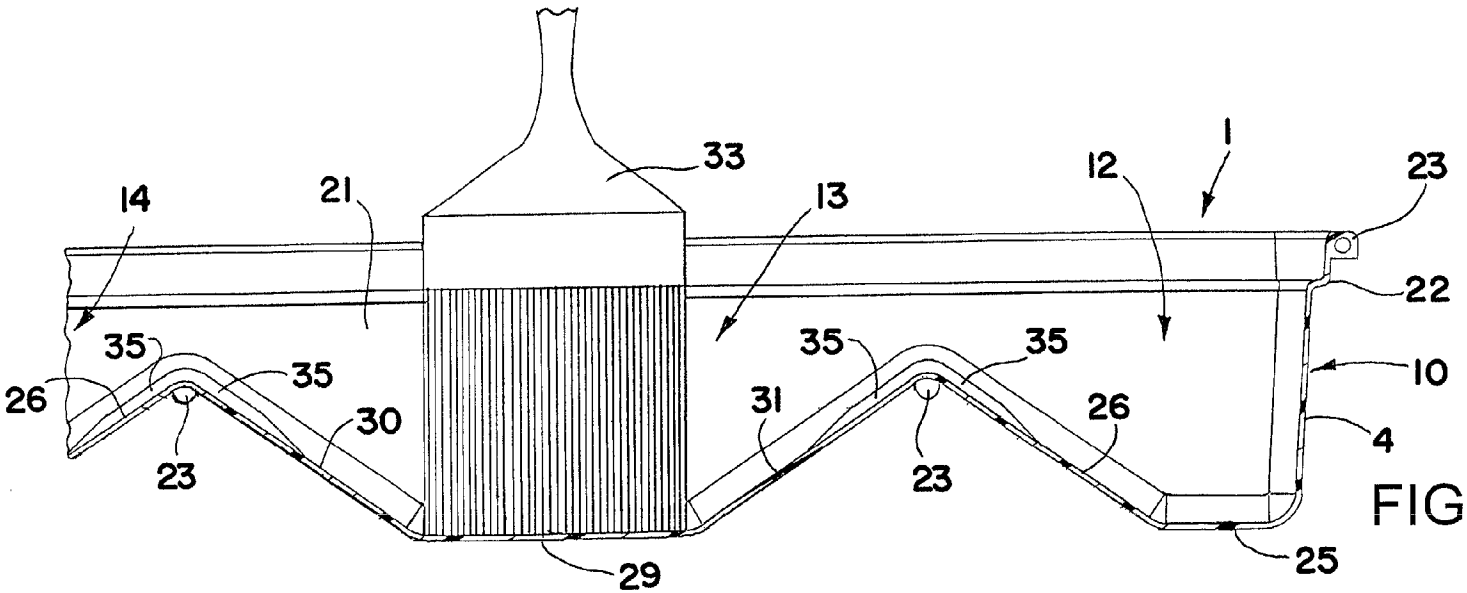

Although the number of compartments 12–14 comprising support member 10 may vary depending on the overall width of the tray and the size of the paint applicators to be held within the compartments, in the embodiment disclosed herein, three such compartments 12–14 are provided, two side compartments 12, 14, one adjacent each side wall 3, 4 of the tray, and a middle compartment 13 between the two side compartments. Each side compartment 12, 14 has a bottom wall 25 and a sloping inner side 26 that slopes sufficiently upwardly and inwardly from the respective bottom wall 25 toward the opposite side wall of the tray for supporting a brush 27 on its side within either side compartment 12, 14 as shown in FIG. 9A. The middle compartment 13 has a bottom wall 29 and opposite sides 30, 31 that slope sufficiently upwardly and outwardly in opposite directions from the bottom wall 29 and blend at their upper ends with the upper ends of the respective sloping inner sides 26 of the respective side compartments 12, 14 for supporting a larger brush 32 on its side adjacent either side of the middle compartment as shown in FIG. 9B. Moreover, the bottom wall 29 of the middle compartment 13 desirably has a width of at least 4 inches to allow a 4 inch brush 33 to be supported upright in the middle compartment as shown in FIG. 9C.

Figure 9D:
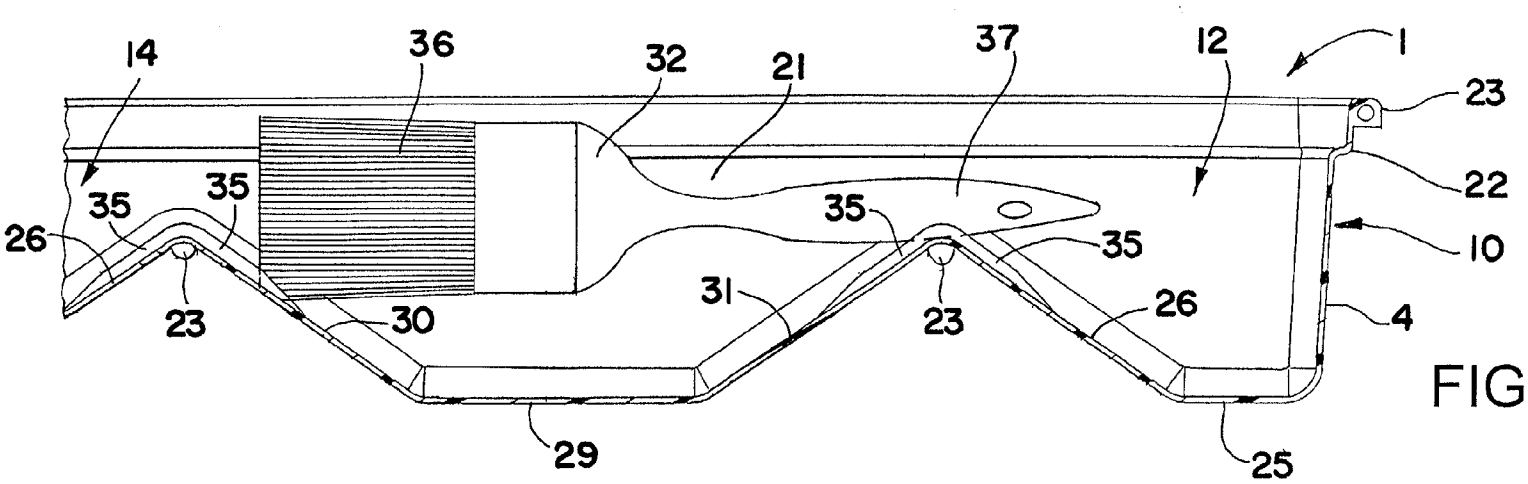
Figure 9E:
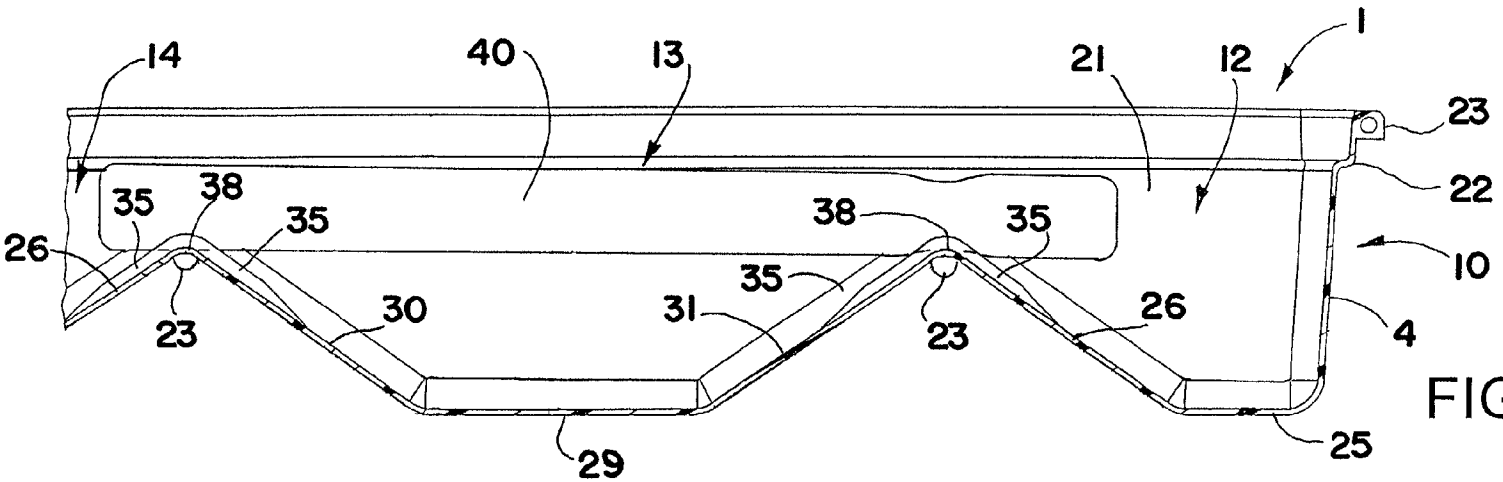

Raised ribs 35 are provided on the sloping inner sides 26 of the respective side compartments 12, 14 and oppositely sloping sides 30, 31 of the middle compartment 13 adjacent upper ends of the sloping sides to keep a brush from falling over when stored on its side with the handle of the brush placed between the raised ribs 35 and an adjacent end wall of the respective compartments as schematically shown in FIGS. 9A and 9B. Also, a larger brush 32 may be placed on its side in the middle compartment 13 with the brush bristles 36 resting against one of the sloping sides 30 and the brush handle 37 placed between the raised rib 35 of the other sloping side 31 and an adjacent end wall of the middle compartment so the brush is supported in a horizontal position above the bottom wall 29 of the middle compartment as shown in FIG. 9D. Further, a stir stick 40 or the like may be stored on its side bridging the middle compartment with the end edges of the stir stick resting on the rounded upper ends 38 of the two sloping sides 30, 31 of the middle compartment between the raised ribs 35 and an adjacent end wall of the middle compartment as shown in FIG. 9E.

Each of the compartments 12–14 can also be used as reservoirs to hold paint when using paint brushes to do touch-up jobs or trim work.

Although the size of the tray 1 may be varied as desired, in one embodiment of the invention, the tray is approximately 21 inches wide and 16 inches long. Also, the tray has an overall height or depth of approximately 4 inches; the paint roller reservoir 7 has a width of approximately 21 inches and a length of approximately 4½ inches to the lowermost edge 42 of the roll off area 8; the roll off area 8 has a width of approximately 21 inches and a length from its lowermost edge 42 to its uppermost end 11 of approximately 9 inches; and the common inner wall 20 of the compartments 12–14 extends above the uppermost end 11 of the roll off area 8 approximately 1 inch. The end compartments 12, 14 have a width at the bottom 25 of approximately 1½ inches, whereas the middle compartment 13 has a width at the bottom 29 of approximately 4 inches. The sloping sides 26, 30 and 31 of the respective compartments have a height of approximately 2 inches and a slope of approximately 35° as measured from the horizontal. Further, each compartment has a length (in the longitudinal direction) of approximately ½ inch at the bottom and approximately 1½ inches at the top. Also, all of the external vertical surfaces of the tray have a slight inward draft from top to bottom to permit a plurality of these trays to be stacked one on top of another.

Because of the relatively large size of the tray 1, the tray is preferably injection molded using gas-assist to aid in the flow of the plastic molding material into the corners of the mold. The gas pressure forces the plastic material through flow channels in the mold (not shown) that are located along the upper edge of the side walls 3, 4 and one end wall 5 of the tray and along the under side of the tray roll off area 8. These flow channels produce hollow closed loop ribs 23 along the upper edge of the side walls 3, 4 and end wall 5 of the tray for increased hoop strength and on the under side of the roll off area 8 to increase the overall rigidity of the tray. All of these closed loop ribs have spaced apart ends integrally formed with the side walls and end walls and under side of the roll off area such that the side and end walls and under side of the roll off area form one side of the respective closed loop ribs. Also these flow channels produce the ribs 35 on the sloping sides 26, 30 and 31 of the respective compartments 12–14 as well as vertical ribs 42 on the inside surface of the inner wall 20 of the support member 10 intermediate the width of the compartments 12–14 as shown in FIGS. 2, 5 and 6, which are also hollow closed loop ribs and are a continuation of the hollow closed loop ribs 23 on the under side of the roll off area 8. Making these ribs hollow closed loop ribs has the advantage that the walls of the ribs can be made to have substantially the same wall thickness as the other wall surfaces of the tray to eliminate the additional shrinkage that would otherwise result if the ribs had a greater wall thickness possibly causing the surfaces to pull or sink in. The rib 23 along the upper edge of the other end wall 6 of the tray, rather than being hollow, is generally U-shaped as shown in FIG. 6 so that its wall thickness can also be made to be the same as the other wall surfaces of the tray. Making the ribs of the same wall thickness as all of the other wall surfaces also reduces the amount of plastic material required to make the tray as well as the cycle time required for cooling the ribs.

Although the invention has been shown and described with respect to a certain embodiment, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiment of the invention. In addition, while a particular feature of the invention may have been disclosed with respect to only one embodiment, such feature may be combined with one or more other features of other embodiments as may be desired and advantageous for any given or particular application.

What is claimed is:

1. A molded plastic paint roller tray having a bottom wall and side and end walls, a paint roller reservoir adjacent one end wall of said tray, a roll off area sloping upwardly away from said paint roller reservoir, a support member longitudinally spaced from said paint roller reservoir for maintaining the slope of said roll off area when said tray is placed on a flat surface, a hollow closed loop rib extending along an upper edge of one or more of said side and end walls, said rib having spaced apart opposite ends integrally formed with said one or more side and end walls such that said one or more side and end walls forms one side of said rib, said support member being hollow and having a closed bottom and open top to provide at least one compartment for holding a paint brush, said support member also having an inner wall and an outer wall outwardly spaced from said inner wall that form inner and outer walls of said compartment, said inner wall being integral with an uppermost end of said roll off area and extending upwardly above the uppermost end of said roll off area across the width of said tray to make said compartment deeper and separate said compartment from said roll off area, and a plurality of laterally spaced longitudinally extending hollow closed loop ribs on an under side of said roll off area, said laterally spaced ribs having spaced apart opposite ends integrally formed with said under side of said roll off area such that said under side of said roll off area forms one side of said laterally spaced ribs.

2. A molded plastic paint roller tray comprising a paint roller reservoir adjacent one end of said tray, a roll off area sloping upwardly away from said paint roller reservoir, and a support member longitudinally spaced from said paint roller reservoir for maintaining the slope of said roll off area when said tray is placed on a flat surface, said support member being hollow and having a closed bottom and open top to provide at least one compartment for holding a paint brush, said support member having an inner wall and an outer wall outwardly spaced from said inner wall that form inner and outer walls of said compartment, said inner wall extending upwardly above an uppermost end of said roll off area across the width of said tray to make said compartment deeper and separate said compartment from said roll off area, wherein said support member includes a side compartment adjacent each side of said tray, each said side compartment having a sloping inner side that slopes upwardly toward the opposite side of said tray at an angle of sufficient slope to support a brush on its side on said sloping inner side within each side compartment.

3. The tray of claim 2 wherein the sloping inner side of each side compartment slopes at an angle of approximately 350° as measured from the plane of the closed bottom of each side compartment.

4. A molded plastic paint roller tray comprising a paint roller reservoir adjacent one end of said tray, a roll off area sloping upwardly away from said paint roller reservoir, and a support member longitudinally spaced from said paint roller reservoir for maintaining the slope of said roll off area when said tray is placed on a flat surface, said support member being hollow and having a closed bottom and open top to provide a side compartment adjacent each side of said tray for holding a paint brush, each said side compartment having a sloping inner side that slopes upwardly toward the opposite side of said tray at an angle of sufficient slope to support a brush on its side on said sloping inner side within each side compartment, and a middle compartment between each said side compartment, said support member having an inner wall that extends upwardly above an uppermost end of said roll off area across the width of said tray to separate said compartments from said roll off area.

5. The tray of claim 4 wherein said middle compartment has opposite sides that slope upwardly in opposite directions toward opposite sides of said tray at angles of sufficient slope to support a brush on its side against either side of said middle compartment and said opposite sides of said middle compartment blend at upper ends with an upper end of the sloping inner side of the respective side compartment.

6. The tray of claim 5 wherein said middle compartment has a width of at least 4 inches at the bottom to allow a 4 inch brush to be supported upright in said middle compartment.

7. The tray of claim 5 wherein said opposite sides of said middle compartment slope at an angle of approximately 35° as measured from the plane of the closed bottom of said middle compartment.

8. The tray of claim 4 further comprising a raised rib on the sloping inner side of each said side compartment to keep a brush from falling over when stored on its side with the handle of the brush placed between the raised rib and an adjacent end wall of the respective side compartment.

9. The tray of claim 8 wherein the raised rib on the sloping inner side of each said side compartment also extends along a portion of the length of the adjacent oppositely sloping side of the middle compartment to keep a brush from falling over when stored on its side with the handle of the brush placed between the raised rib on one of the oppositely sloping sides of the middle compartment and an adjacent end wall of the middle compartment.

10. A molded plastic paint roller tray comprising a paint roller reservoir adjacent one end of said tray, a roll off area sloping upwardly away from said paint roller reservoir, and a support member longitudinally spaced from said paint roller reservoir for maintaining the slope of said roll off area when said tray is placed on a flat surface, said support member being hollow and having a closed bottom and open top to provide a side compartment adjacent each side of said tray for holding a brush, and a middle compartment between each said side compartment, each said side compartment having a sloping inner side that slopes upwardly toward the opposite side of said tray at an angle of sufficient slope to support a brush on its side on said sloping inner side within a side compartment, and said middle compartment has opposite sides that slope upwardly in opposite directions toward opposite sides of said tray at angles of sufficient slope to support a brush on its side against either side of said middle compartment and said opposite sides of said middle compartment blend at upper ends with an upper end of the sloping inner side of the respective side compartment.

11. The tray of claim 10 wherein the sloping inner side of each side compartment slopes at an angle of approximately 35° as measured from the plane of the closed bottom of each side compartment, and said opposite sides of said middle compartment slope at an angle of approximately 35° as measured from the plane of the closed bottom of said middle compartment.

* * * * *